US012435483B2

(12) United States Patent
Trieste, Jr.

(10) Patent No.: US 12,435,483 B2
(45) Date of Patent: Oct. 7, 2025

(54) INSULATING COVER FOR A UTILITY MANHOLE

(71) Applicant: Consolidated Edison Company of New York, Inc., New York, NY (US)

(72) Inventor: Richard J. Trieste, Jr., Staten Island, NY (US)

(73) Assignee: CONSOLIDATED EDISON COMPANY OF NEW YORK, INC., New York, NY (US)

( * ) Notice: Subject to any disclaimer, the term of this patent is extended or adjusted under 35 U.S.C. 154(b) by 826 days.

(21) Appl. No.: 17/710,124

(22) Filed: Mar. 31, 2022

(65) Prior Publication Data

US 2022/0341121 A1 Oct. 27, 2022

Related U.S. Application Data

(60) Provisional application No. 63/178,164, filed on Apr. 22, 2021.

(51) Int. Cl.
*E02D 29/14* (2006.01)

(52) U.S. Cl.
CPC ..... *E02D 29/14* (2013.01)

(58) Field of Classification Search
CPC ..... E02D 29/14
USPC ..... 404/25
See application file for complete search history.

(56) References Cited

U.S. PATENT DOCUMENTS 4,050,839 A * 9/1977 Vollmar ..... E02D 29/1409 52/21
5,052,851 A * 10/1991 Frishauf ..... E02D 29/14 404/25
5,240,346 A * 8/1993 Yin ..... E02D 29/149 404/25
5,536,110 A * 7/1996 Tompkins ..... E01C 9/00 404/26
6,682,257 B1 * 1/2004 Zappe ..... E02D 29/149 404/25
6,887,012 B1 * 5/2005 Zappe ..... E02D 29/14 404/25
7,153,057 B1 * 12/2006 Lucas ..... E02D 29/14 404/25
7,491,010 B2 * 2/2009 Cuny ..... E02D 29/14 404/25
7,975,436 B2 * 7/2011 Newton ..... H02G 9/025 404/25

FOREIGN PATENT DOCUMENTS

WO WO-2018008301 A1 * 1/2018 ..... B63B 19/00

OTHER PUBLICATIONS

Lisowski, Edward et al., "Influence of vacuum level on insulation thermal performance for LNG cryogenic road tankers" MATEC Web of Conferences 240, 01019 (2018) 4 pgs.

* cited by examiner

*Primary Examiner* — Gary S Hartmann
(74) *Attorney, Agent, or Firm* — CANTOR COLBURN LLP

(57) ABSTRACT

An insulating manhole cover for an opening in an underground utility structure and a method of insulating underground utility structure includes an insulation element disposed in the opening. A support member is coupled to the insulation element, the support member being configured to operably couple with the opening. A cover is at least partially disposed within the opening and in contact with the support member opposite the insulation element.

19 Claims, 3 Drawing Sheets

INSULATING COVER FOR A UTILITY MANHOLE

CROSS REFERENCE TO RELATED APPLICATIONS

This application claims the benefit of U.S. Provisional Application Ser. No. 63/178,164, filed Apr. 22, 2021, the entire disclosure of which is incorporated herein by reference.

BACKGROUND

The subject matter disclosed herein relates to a cover for a utility manhole, and in particular to an insulated manhole cover.

Many utilities, such as electricity, natural gas, and steam pipes (i.e. district heating) for example, route their equipment underground. To allow for the servicing and inspection of the utility equipment, underground structures or chambers may be provided to allow utility personnel access to the equipment. Access to these underground structures is typically provided by an opening in the ceiling of the structure. The opening is closed by a cover, colloquially referred to as a manhole cover. The openings to the underground structures are often located in public streets. As a result, the manhole cover needs to be strong enough to withstand the weight of vehicles, while also being light enough to be removable by utility personnel. A typical manhole cover is made from an iron casting having a diameter of 22 to 60 inches in diameter and weighs between 250 to 300 pounds.

In the case of underground structures that include utilities such as steam pipes, the temperature within the underground structure may be elevated. In some instances the temperatures within the underground structure may reach temperatures in excess of 400° F. It should be appreciated that the top surface of the manhole cover, which may be positioned at the top of the underground structure, may be exposed to undesired temperature levels since the manhole cover is made from a thermally conductive metal.

Accordingly, while existing manhole covers are suitable for their intended purposes the need for improvement remains, particularly in providing a manhole cover system having the features described herein.

BRIEF DESCRIPTION

According to one aspect of the disclosure a manhole cover for an opening in an underground utility structure is provided. The manhole cover includes an insulation element is disposed in the opening. A support member is coupled to the insulation element, the support member being configured to operably couple with the opening. A cover is at least partially disposed within the opening and in contact with the support member opposite the insulation element.

In addition to one or more of the features described herein, or as an alternative, further embodiments of the manhole cover may include the insulation element having a hollow interior.

In addition to one or more of the features described herein, or as an alternative, further embodiments of the manhole cover may include the hollow interior having a pressure below ambient pressure.

In addition to one or more of the features described herein, or as an alternative, further embodiments of the manhole cover may include the pressure being greater than or equal to 0 psi.

In addition to one or more of the features described herein, or as an alternative, further embodiments of the manhole cover may include an insulating gas disposed in the hollow interior. In addition to one or more of the features described herein, or as an alternative, the insulating gas is argon. In addition to one or more of the features described herein, or as an alternative, the insulating gas is air.

In addition to one or more of the features described herein, or as an alternative, further embodiments of the manhole cover may include the insulation element having a bottom wall and at least one sidewall extending between the bottom wall and the support member, the bottom wall, the sidewall, and the support member defining the hollow interior.

In addition to one or more of the features described herein, or as an alternative, further embodiments of the manhole cover may include the support member having an element defining an opening between the environment and the underground utility structure.

According to another aspect of the disclosure a method of insulating a manhole cover for an opening in an underground utility structure is provided. The method includes providing a support member configured to operably couple with the opening. An insulation element is coupled to a side of the support member. The support member is placed on the opening with the insulation element disposed in the underground utility structure. A cover is placed at least partially disposed within the opening and in contact with the support member opposite the insulation element.

In addition to one or more of the features described herein, or as an alternative, further embodiments of the method may include inhibiting thermal transfer through the insulation element with a vacuum.

In addition to one or more of the features described herein, or as an alternative, further embodiments of the method may include inhibiting thermal transfer through the insulation element with a gas.

In addition to one or more of the features described herein, or as an alternative, further embodiments of the method may include the gas being one of air and argon.

According to yet another aspect of the disclosure a manhole cover for an opening in an underground utility structure is provided. The opening having a support frame at least partially disposed within the opening. The manhole cover includes a support member operably coupled to the support frame within the opening. An insulation element is coupled to a side of the support member, the insulation element having an interior portion. A cover is at least partially disposed within the opening and in contact with the support member opposite the insulation element.

In addition to one or more of the features described herein, or as an alternative, further embodiments of the manhole cover may include the interior portion having a pressure below ambient pressure.

In addition to one or more of the features described herein, or as an alternative, further embodiments of the method may include the interior portion having a gas pressure equal to or greater than ambient pressure.

In addition to one or more of the features described herein, or as an alternative, further embodiments of the method may include the gas being one of air, argon, or a combination thereof.

In addition to one or more of the features described herein, or as an alternative, further embodiments of the method may include the support element at least partially defines a fluid path between the underground utility structure and the environment.

In addition to one or more of the features described herein, or as an alternative, further embodiments of the method may include the fluid path being defined by a plurality of standoff elements arranged between the side of the support element and the support frame.

In addition to one or more of the features described herein, or as an alternative, further embodiments of the method may include the cover being removably coupled to the support element.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments of the present disclosure provide advantages in insulating and reducing the top surface temperature of manhole covers, such as those that enclose the entrances of underground utility structures that have heat generating elements, such as steam pipes for example. Further embodiments of the present disclosure provide for an insulating system or device the may be used in existing manhole entrances with existing manhole covers with modification. Still further embodiments of the present disclosure allow the manhole cover to be separately removed from the manhole entrance from an insulating system or device to reduce the risk of damaging the insulating system or device.

Figure 1:
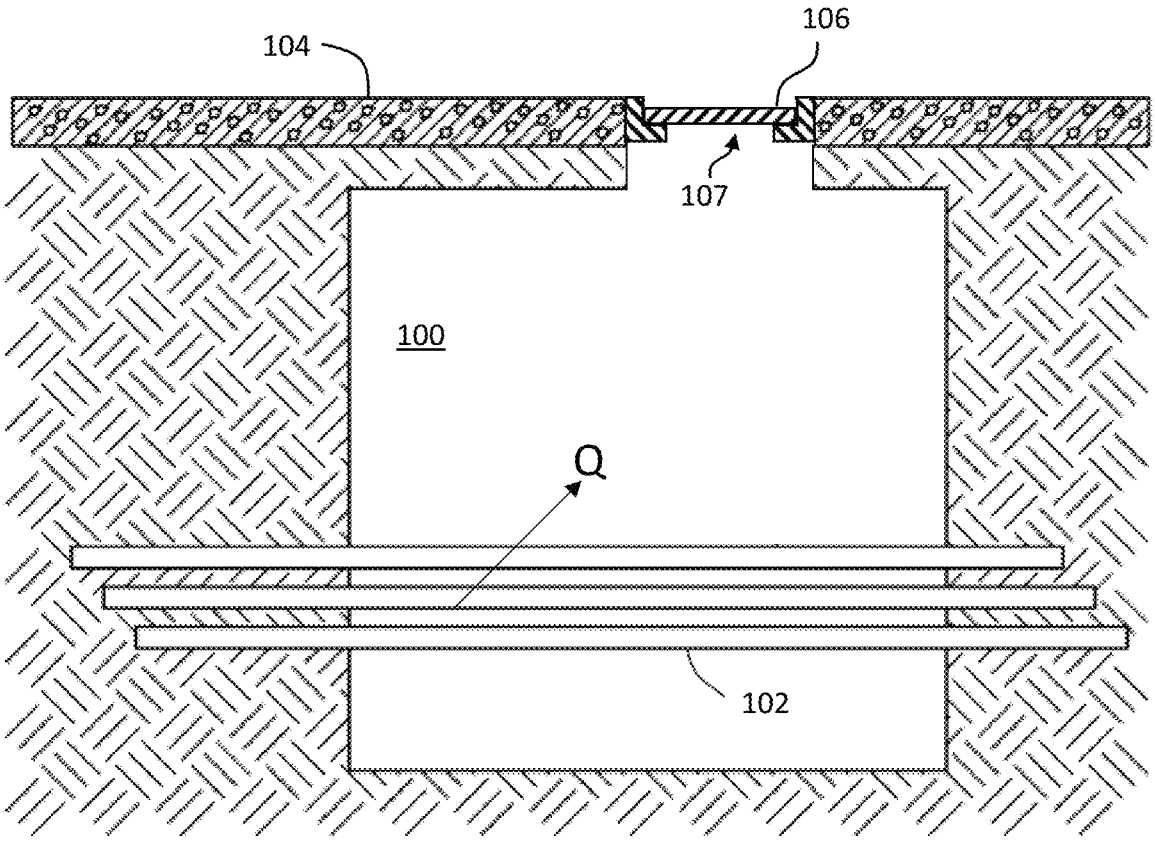
FIG. 1 is side schematic sectional view of an underground utility structure that includes heat generating utility elements.

Referring now to FIG. 1, an embodiment is shown of an underground structure 100 such as that used for utilities, such as steam pipes 102 for example, that operate at a temperature that is higher than ambient temperature. In the case of a steam pipe utility, the thermal energy Q that is transferred to the underground structure 100 may raise the temperature in the underground structure 100. In some instances, such as when the insulation around the steam pipe is broken, missing or there are uninsulated components, the temperatures within the underground structure 100 may reach about 413° F. Underground structures of this type are often located adjacent to, or beneath, city streets 104. The underground structure 100 may be enclosed, and separated from the street 104 or sidewalk above, by a manhole cover 106. Manhole covers 106 are typically round, and are made from cast iron. It should be appreciated that the temperature of the manhole cover 106 may become elevated due to the temperature within the underground structure 100.

Typically the opening to the underground structure 100 includes a cover ring that defines an opening 107. The opening 107 provides an egress for utility personnel to enter and exit the underground structure 100. When the cover 106 is placed on the cover ring, the opening 107 is closed.

Figure 2:
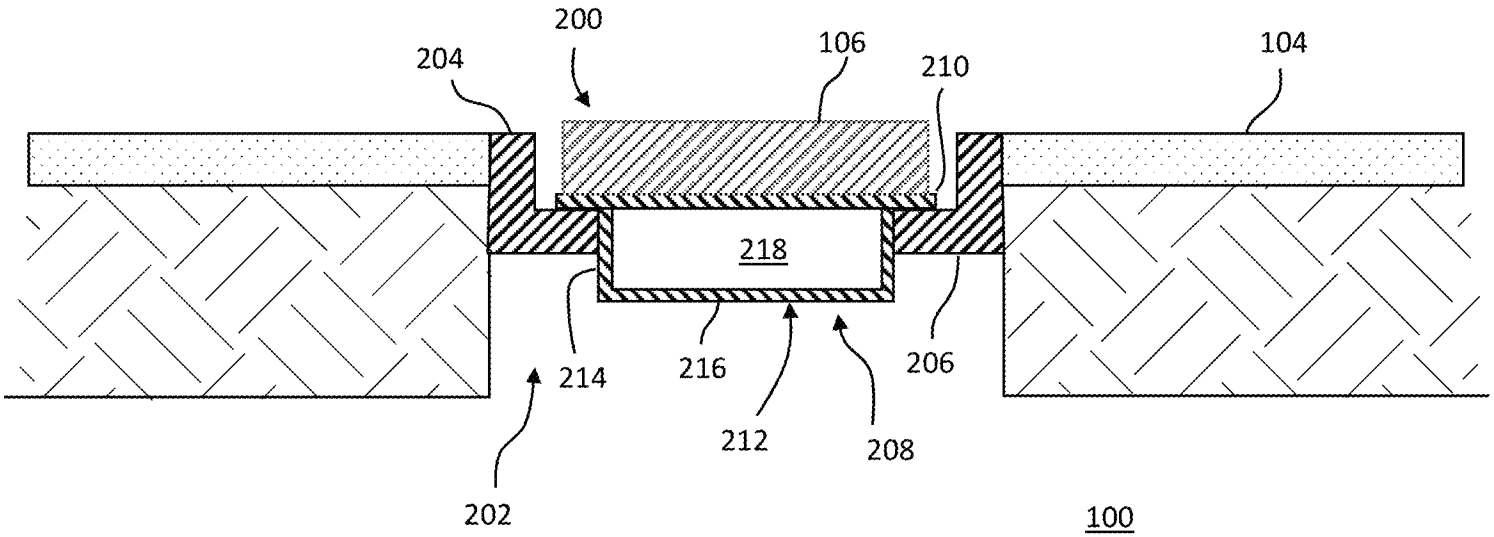
FIG. 2 is a side schematic sectional view of the entrance to the underground utility structure of FIG. 1 in accordance with an embodiment.

Referring now to FIG. 2, and embodiment is shown of an insulated manhole cover assembly 200. The assembly 200 includes the manhole cover 106. As seen in FIG. 2, in a prior art installation, the opening 202 that connects the underground structure 100 with the ambient environment includes a frame or cover ring 204. The cover ring 204 defines the opening that utility personnel climb through when entering the underground structure 100. The cover ring 204 includes a flange 206 that the manhole cover 106 rests on. The flange 206 is spaced apart from the surface of the street 104. In an embodiment, the distance is equal to or greater than the thickness of the manhole cover 106.

In an embodiment, the assembly 200 further includes an insulation assembly 208. The insulation assembly 208 is disposed between the manhole cover 106 and the interior of the underground structure 100. As such the insulation assembly 208 reduces or minimizes the transfer of thermal energy (i.e. the conduction of heat) from the underground structure 100 to the manhole cover 106. It should be appreciated that the insulation assembly reduces the temperature of the manhole cover 106 when the temperatures within the underground structure 100 are elevated.

In an embodiment, the insulation assembly 208 includes a support element 210 and an insulation element 212. In the illustrated embodiment, the support element 210 is a flat/planar member that is sized to rest or be supported by the flange 206 when the insulation assembly 208 is placed over or within the opening 107 (FIG. 1). In an embodiment, the support element 210 has a thickness sized such that the top surface manhole cover 106, when placed on top of the insulation assembly 208, will either be located below, or within a predetermined distance, of the top surface of the street/ground 104. In the illustrated embodiment, the insulation element 212 includes a side wall 214 and a bottom wall 216. In an embodiment, the walls 214, 216 and the insulation element 212 cooperate to define a hollow interior 218. In an embodiment, the hollow interior 218 is sealed from the external environment. In an embodiment, the pressure within the hollow interior 218 is less than ambient pressure. In an embodiment, the hollow interior 218 is a vacuum. In an embodiment, the pressure within the hollow interior 218 is between 0 psi and ambient pressure.

In an embodiment, the hollow interior may include an insulating gas. The insulating gas my include, but is not limited to air or argon for example. In an embodiment, the insulating gas is at a pressure greater than or equal to ambient pressure.

It should be appreciated that while the insulating assembly 208 is illustrated with the top of the hollow interior 218 as being formed by the support element 210, this is for example purposes and the claims should not be so limited. In other embodiments, the hollow interior is defined by a top wall (not shown that is coupled to the support element 210. In still other embodiments, the hollow interior is defined by a top wall and a flange extends from a top portion of the side wall 214. The flange engages the flange 206 to support the insulation assembly 208.

Figure 3:
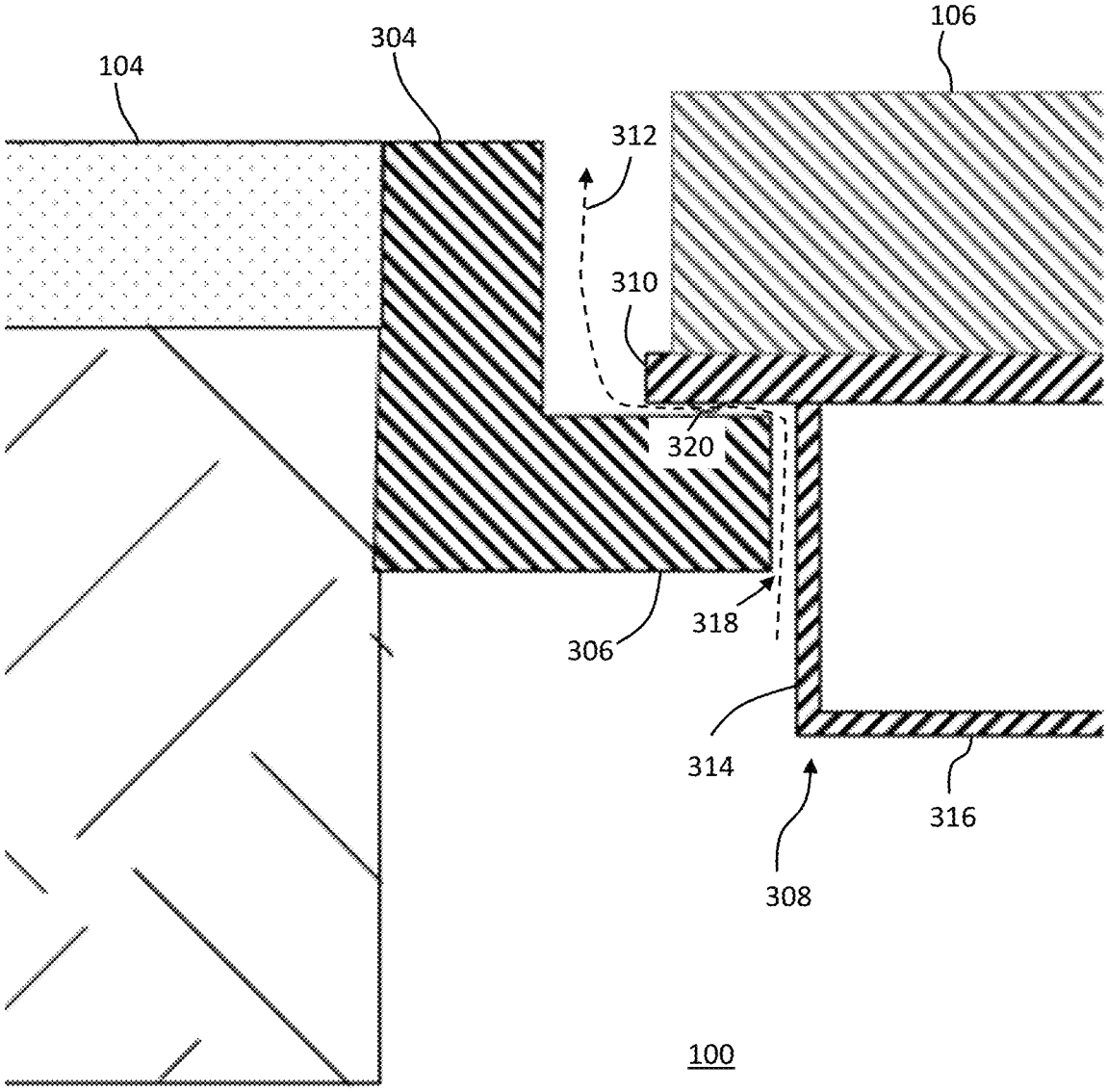
FIG. 3 is an enlarged side sectional view of a portion of the entrance to the underground utility structure of FIG. 1 in accordance with another embodiment.

In the embodiment of FIG. 2, the side walls 214 are sized to fit tightly within the opening 107. Referring now to FIG. 3, an embodiment is shown wherein the insulation assembly 308 defines a fluid path 312 from the interior of the underground structure 100 to the ambient environment. In this embodiment, the insulation assembly 308 is configured in the same manner as insulation assembly 208, with a side wall 314 and a bottom wall 316. In this embodiment, the side walls 314 are sized to provide a gap 318 between the side wall 314 and the inside edge or side of the flange 306 of the cover ring 304. In this embodiment, the support element 310 includes a plurality of standoffs or projections 320 that cause the bottom of the support element 310 to be spaced apart from the top surface of the flange 306. In other embodiments the cover ring 304 may include recesses in the top surface of flange 306 such that support element 310 is recessed in part or in whole into flange 306. The projections 320 are spaced apart about the periphery of the support element 310 to allow a fluid/gas to flow therethough.

In some embodiments, the increase in temperature within the underground structure 100 coincides with an increase in pressure. It may be desirable to allow this pressure to be vented from the underground structure 100. Thus the fluid path 312 allows the release of pressure from within the underground structure 100 while still providing an insulation barrier between the manhole cover 106 and the underground structure 100.

In operation, to install the insulation assembly 208, the utility personnel first remove the manhole cover 106. The insulation element 208 is placed within the hole 107. In an embodiment, the insulation element 208 is sized to extend through the opening 107 and at least partially into the underground structure 100. With the support element 210 in contact with the insulation element 212, the manhole cover 106 may be placed on top of the insulation assembly 208. It should be appreciated that due to the weight of the manhole cover 106, the insulation assembly 208 is captured within the entrance to the underground structure 100.

When utility personnel need to enter the underground structure 100, first the manhole cover 106 is removed and set aside. With the manhole cover 106 removed, the utility personnel can access and remove the insulation assembly 208. In embodiments, where the insulation element 208 is not directly coupled to the manhole cover 106, this can provide advantages in reducing the risk of damage to the insulation assembly 208 due to the weight of the manhole cover (about 250 pounds). Once the activity in the underground structure 100 is completed, the utility personnel reverse the process by installing the insulation element 208 and the manhole cover 106.

The term "about" is intended to include the degree of error associated with measurement of the particular quantity based upon the equipment available at the time of filing the application. For example, "about" can include a range of ±8% or 5%, or 2% of a given value.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection." It should also be noted that the terms "first", "second", "third", "upper", "lower", and the like may be used herein to modify various elements. These modifiers do not imply a spatial, sequential, or hierarchical order to the modified elements unless specifically stated.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A manhole cover for an opening in an underground utility structure comprising:

an insulation element disposed in the opening;

a support member coupled to the insulation element, the support member being configured to operably couple with a cover ring that defines the opening; and a cover at least partially disposed within the opening and in contact with the support member opposite the insulation element, wherein the opening has a support frame at least partially disposed within the opening, and wherein a plurality of standoff elements are arranged between a side of the support member and the support frame.

2. The manhole cover of claim 1, wherein the insulation element includes a hollow interior.

3. The manhole cover of claim 2, wherein the hollow interior has a pressure below ambient pressure.

4. The manhole cover of claim 3, wherein the pressure is greater than or equal to 0 psi.

5. The manhole cover of claim 2, further comprising an insulating gas disposed in the hollow interior.

6. The manhole cover of claim 5, wherein the insulating gas is argon.

7. The manhole cover of claim 5, wherein the insulating gas is air.

8. The manhole cover of claim 2, wherein the insulation element includes a bottom wall and at least one sidewall extending between the bottom wall and the support member, the bottom wall, the sidewall, and the support member defining the hollow interior.

9. A method of insulating a manhole cover for an opening in an underground utility structure, the method comprising:

providing a support member configured to operably couple with a cover ring that defines the opening;

providing an insulation element coupled to a side of the support member;

placing the support member on the opening with the insulation element disposed in the underground utility structure; and placing a cover at least partially disposed within the opening and in contact with the support member opposite the insulation element, wherein the opening has a support frame at least partially disposed within the opening, and wherein a plurality of standoff elements are arranged between a side of the support member and the support frame.

10. The method of claim 9, further comprising inhibiting thermal transfer through the insulation element with a vacuum.

11. The method of claim 9, further comprising inhibiting thermal transfer through the insulation element with a gas.

12. The method of claim 11, wherein the gas is one of air and argon.

13. A manhole cover for an opening in an underground utility structure, the opening having a support frame at least partially disposed within the opening, the manhole cover comprising:

a support member operably coupled to the support frame within the opening;

an insulation element coupled to a side of the support member, the insulation element having an interior portion; and a cover at least partially disposed within the opening and in contact with the support member opposite the insulation element, wherein a plurality of standoff elements are arranged between a side of the support member and the support frame.

14. The manhole cover of claim 13, wherein the interior portion has a pressure below ambient pressure.

15. The manhole cover of claim 13, wherein the interior portion has a gas pressure equal to or greater than ambient pressure.

16. The manhole cover of claim 15, wherein the gas is one of air, argon, or a combination thereof.

17. The manhole cover of claim 13, wherein the support element at least partially defines a fluid path between the underground utility structure and the environment.

18. The manhole cover of claim 17, wherein the fluid path is defined by the plurality of standoff elements arranged between the side of the support element and the support frame.

19. The manhole cover of claim 13, wherein the cover is removably coupled to the support element.

* * * * *